US010124863B2

(12) United States Patent
Borden, Jr. et al.

(10) Patent No.: US 10,124,863 B2
(45) Date of Patent: Nov. 13, 2018

(54) COLLAPSIBLE CHAIR WITH TWO LEGS

(71) Applicants: William Joseph Borden, Jr., Haslet, TX (US); Shari Rae Borden, Haslet, TX (US); Scott Charles Pendleton, Fort Worth, TX (US); Ron DeArmond, Hurst, TX (US)

(72) Inventors: William Joseph Borden, Jr., Haslet, TX (US); Shari Rae Borden, Haslet, TX (US); Scott Charles Pendleton, Fort Worth, TX (US); Ron DeArmond, Hurst, TX (US)

( * ) Notice: Subject to any disclaimer, the term of this patent is extended or adjusted under 35 U.S.C. 154(b) by 24 days.

(21) Appl. No.: 15/338,743

(22) Filed: Oct. 31, 2016

(65) Prior Publication Data

US 2017/0043842 A1 Feb. 16, 2017

Related U.S. Application Data

(60) Provisional application No. 62/354,213, filed on Jun. 24, 2016.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043; A47C 4/28; A47C 4/286; A47C 4/48
See application file for complete search history.

(56) References Cited

U.S. PATENT DOCUMENTS

| | | | | |
|---|---|---|---|---|
| 5,651,706 | A * | 7/1997 | Kasper | B63B 7/082 114/354 |
| 6,926,355 | B2 * | 8/2005 | Le Gette | A45F 4/02 297/129 |
| 8,573,146 | B2 * | 11/2013 | Lee | B63B 3/48 114/363 |
| 2009/0038526 | A1 * | 2/2009 | Walton | B63B 29/04 114/347 |
| 2010/0096890 | A1 * | 4/2010 | Whitlock | A47C 4/286 297/16.2 |
| 2013/0239873 | A1 * | 9/2013 | Dow | B63B 29/04 114/363 |

* cited by examiner

*Primary Examiner* — Philip F Gabler
(74) *Attorney, Agent, or Firm* — Barry Choobin; Patent 360

(57) ABSTRACT

The embodiments herein provide a collapsible and foldable chair. The collapsible chair includes a harness member for fastening to an object. The collapsible chair comprises a seating assembly, a pair of front legs, midcross bars, a left arm support, and a right arm support. The seating assembly comprises a seat and a backrest. The seating assembly is collapsible and foldable for storage. The pair of front legs are extended from the seat assembly. A pair of front legs are hinged to a footer base. The mid-cross bars are designed to connect the seating assembly with the pair of front legs.

10 Claims, 4 Drawing Sheets

COLLAPSIBLE CHAIR WITH TWO LEGS

BACKGROUND

Technical Field

The embodiments herein are generally related to a collapsible chair. The embodiments herein are more particularly related to a collapsible chair with two legs. The embodiments herein are more particularly related to a collapsible chair with harness members used to provide connection with an object.

Description of the Related Art

Typical collapsible chairs include elongate members that are entirely disposed at or near the front portion of the chair and other elongate members that are entirely disposed at or near the back portion of the chair. Such collapsible chairs are often cumbersome to expand and collapse. Additionally, manufacturing such collapsible chairs require numerous connections and coupling members resulting in increased manufacturing time and expenses.

The existing collapsible chairs are assembled using several types of elongate members. For example, some known collapsible chairs are assembled using four or more types of elongate members. As the number of types of elongate member is increased, the manufacturing cost and assembly time is also increased. Moreover, the existing collapsible chairs do not provide harness or connecting members to facilitate attachment to a personal water craft or jetski.

Hence, there is a need for an improved collapsible chair with reduced connectors and/or coupling members. There is also a need for a collapsible chair that is attached to various objects such as jetski or personal watercraft. There is also a need for a collapsible chair that is folded easily for storage.

The above mentioned shortcomings, disadvantages and problems are addressed herein and which will be understood by reading and studying the following specification.

OBJECTS OF THE EMBODIMENTS

The primary object of the embodiments herein is to provide a collapsible chair with two front legs.

Another object of the embodiments herein is to provide a chair with a seating assembly that is easily collapsible.

Yet another object of the embodiments herein is to provide a collapsible chair with harness members for fastening the chair to a personal watercraft.

Yet another object of the embodiments herein is to provide a collapsible chair with mid-cross bars and collapsible bars to provide stability.

Yet another object of the embodiments herein is to provide a collapsible chair that is easy to be stored.

Yet another object of the embodiments herein is to provide a chair using a cross bar or 'X design'.

Yet another object of the embodiments herein is to provide a collapsible chair with fabric sling member enabling a person to sit and lean back on the backrest.

Yet another object of the embodiments herein is to provide a collapsible chair made up of materials including steel, hooks, clamps, aluminum, webbing, Velcro, stitching, bungie cord, canvas, mesh material, clasps, plastic, PVC, and neoprene.

These and other objects and advantages of the embodiments herein will become readily apparent from the following detailed description taken in conjunction with the accompanying drawings.

SUMMARY

The various embodiments herein provide a chair that is collapsible and foldable. The embodiments herein provide a collapsible chair with harness members to fasten the chair to a personal watercraft. The embodiments herein provide a collapsible chair with mid-cross bars and collapsible bars to provide stability. The embodiments herein provide a collapsible chair with fabric sling member to enable a person to sit and lean back on the backrest.

According to an embodiment herein, the chair comprises a seat and backrest mounted on a foldable chair support assembly with a pair of legs. The pair of legs are configured to define a first base for supporting the chair on a bearing surface in the open position and a second base for supporting the seat and backrest. Both the seat and backrest include a pair of lateral support assemblies for reinforcing the seat and backrest and stabilizing the folding chair.

According to an embodiment herein, the seat support assemblies include a pivot joint that is configured to define an axis across which the seat is folded in a first direction.

According to an embodiment herein, a collapsible chair comprises a seating assembly, a pair of front legs, mid-cross bars, a left arm support, and a right arm support. The seating assembly comprises a seat and a backrest. The seating assembly is further collapsed and folded for storage. The pair of front legs are extended from the seating assembly. The pair of front legs are hinged to a footer/foot rest. The midcross bars are configured to connect the seating assembly with the pair of front legs. The midcross bars are designed to provide stability to the collapsible chair. The left arm is extended from the seating assembly. The left arm is hinged to a left sidebar and the midcross bars respectively. The right arm is extended from the seating assembly. The right arm is hinged to a right sidebar and the midcross bars respectively. The front harness is extended from the pair of legs, and designed/configured to hold the front legs upright using a backend secure fastened to the mid-sections of each leg. A front section of the front harness is secured to the back of a personal watercraft (pwc).

According to an embodiment herein, the chair is made up of materials selected from a group consisting of steel, hooks, clamps, aluminum, webbing, Velcro, stitching, bungie cord, canvas, mesh material, clasps, plastic, pvc, and neoprene.

According to an embodiment herein, the pair of front legs, the right arm, the left arm, and backrest in the chair utilize collapsible bars for providing stability and storage functionality. The midcross bars is designed/formed/fabricated in the shape of 'X' or diagonally arranged across the front of the chair for providing stability. The seating further comprises a fabric sling to allow a person to sit and lean back on the backrest.

These and other aspects of the embodiments herein will be better appreciated and understood when considered in conjunction with the following description and the accompanying drawings. It should be understood, however, that the following descriptions, while indicating the preferred embodiments and numerous specific details thereof, are given by way of an illustration and not of a limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1A:
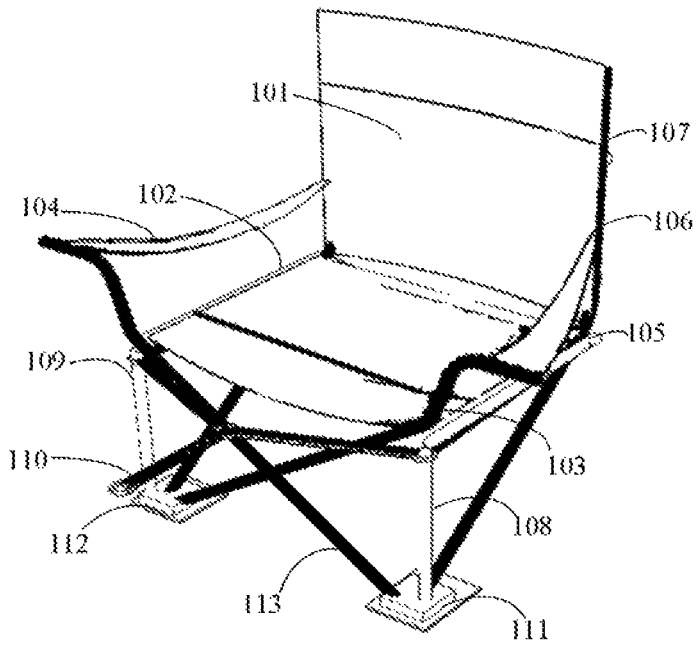
FIG. 1A illustrates a front perspective view of a collapsible chair according to an embodiment herein.

Although the specific features of the embodiments are shown in some drawings and not in others. This is done for convenience only as each feature may be combined with any or all of the other features in accordance with the embodiments.

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a chair that is collapsible and foldable. The embodiments herein provide a collapsible chair with harness members to fasten the chair to a personal watercraft. The embodiments herein provide a collapsible chair with mid-cross bars and collapsible bars to provide stability. The embodiments herein provide a collapsible chair with fabric sling member to enable a person to sit and lean back on the backrest.

According to an embodiment herein, the chair comprises a seat and backrest mounted on a foldable chair support assembly with a pair of legs. The pair of legs are configured to define a first base for supporting the chair on a bearing surface in the open position and a second base for supporting the seat and backrest. Both the seat and backrest include a pair of lateral support assemblies for reinforcing the seat and backrest and stabilizing the folding chair.

According to an embodiment herein, the seat support assemblies include a pivot joint that is configured to define an axis across which the seat is folded in a first direction.

According to an embodiment herein, a collapsible chair comprises a seating assembly, a pair of front legs, mid-cross bars, a left arm support, and a right arm support. The seating assembly comprises a seat and a backrest. The seating assembly is further collapsed and folded for storage. The pair of front legs are extended from the seating assembly. The pair of front legs are hinged to a footer/foot rest. The midcross bars are configured to connect the seating assembly with the pair of front legs. The midcross bars are designed to provide stability to the collapsible chair. The left arm is extended from the seating assembly. The left arm is hinged to a left sidebar and the midcross bars respectively. The right arm is extended from the seating assembly. The right arm is hinged to a right sidebar and the midcross bars respectively. The front harness is extended from the pair of legs, and designed/configured to hold the front legs upright using a backend secure fastened to the mid-sections of each leg. A front section of the front harness is secured to the back of a personal watercraft (pwc).

According to an embodiment herein, the chair is made up of materials selected from a group consisting of steel, hooks, clamps, aluminum, webbing, Velcro, stitching, bungie cord, canvas, mesh material, clasps, plastic, pvc, and neoprene.

According to an embodiment herein, the pair of front legs, the right arm, the left arm, and backrest in the chair utilize collapsible bars for providing stability and storage functionality. The midcross bars is designed/formed/fabricated in the shape of 'X' or diagonally arranged across the front of the chair for providing stability. The seating further comprises a fabric sling to allow a person to sit and lean back on the backrest.

FIG. 1 illustrates a front side perspective view of a collapsible chair, according to an embodiment herein. According to an embodiment herein, a collapsible chair comprises a seating assembly, a pair of front legs, midcross bars 113, a left arm support 103, a right arm support 104. The seating assembly comprises a seat 102 and a backrest 101. Further the seating assembly is collapsible and foldable for storage. The pair of front legs 108, 109 are extended from the seating assembly. The pair of front legs are hinged to footer 111, 112. The midcross bars 113 are designed to connect the seating assembly with the pair of front legs. The midcross bars 113 are designed to provide stability to the collapsible chair. The left arm support 103 is extended from the seating assembly. The left arm support 103 is hinged to a left sidebar 105 and the midcross bars 113 respectively. The right arm support 104 is extended from the seating assembly. The right arm support 104 is hinged to a right sidebar and the midcross bars 113 respectively. The front harness 110 is extended from the pair of legs and designed to hold the front legs upright using a backend securely fastened to the mid-sections of each leg. A front section of the front harness comprises a strap which is secured to the back of a personal watercraft (pwc).

According to an embodiment herein, the chair is made of materials selected from a group consisting of steel, hooks, clamps, aluminum, webbing, Velcro, stitching, bungie cord, canvas, mesh material, clasps, plastic, PVC, and neoprene.

According to an embodiment herein, the pair of front legs, right arm, left arm, and backrest member in the chair utilize collapsible bars for providing stability and storage functionality. The midcross bars is designed in the shape of 'X' or diagonally arranged across the front of the chair for providing stability. The seating member further comprises a fabric sling member to allow a person to sit and lean back on the backrest.

Figure 1B:
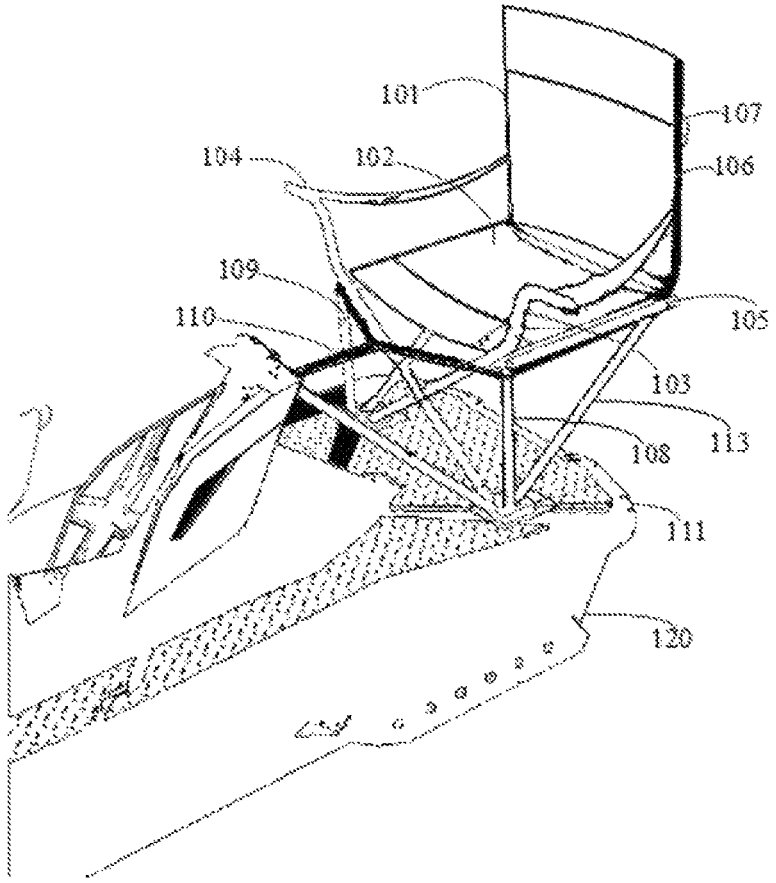
FIG. 1B illustrates a right perspective view of a collapsible chair, according to an embodiment herein.

FIG. 1B illustrates a right side perspective view of a collapsible chair, according to an embodiment herein. According to an embodiment herein, a collapsible chair comprises a seating assembly, a pair of front legs, midcross bars 113, a left arm support 103, and a right arm support 104. The seating assembly comprises a seat 102 and a backrest 101. The seating assembly is further collapsible and foldable for storage. The pair of front legs 108, 109 are extended from the seating assembly. The pair of front legs are hinged to footer 111, 112. The midcross bars 113 are designed to connect the seating assembly with the pair of front legs. The midcross bars 113 are configured to provide stability to the collapsible chair. The left arm support 103 is extended from the seating assembly. The left arm support 103 is hinged to a left sidebar 105 and the midcross bars 113 respectively. The right arm support 104 is extended from the seating assembly. The right arm support 104 is hinged to a right sidebar and the midcross bars 113 respectively.

With respect to FIG. 1B, the midcross bars and the pair of legs are attached to the pwc 120 at a foot X brace 111.

According to an embodiment herein, the collapsible chair comprises a harness member 110 to fasten the chair to a personal watercraft. The harness includes a front harness and a backend secure fastener. The front harness is extended from the pair of legs and is designed to hold the front legs upright using a backend secure fastened to the mid-sections of each leg. A front section of the front harness is secured to the back of an object such as personal watercraft (PWC) 120.

Figure 1C:
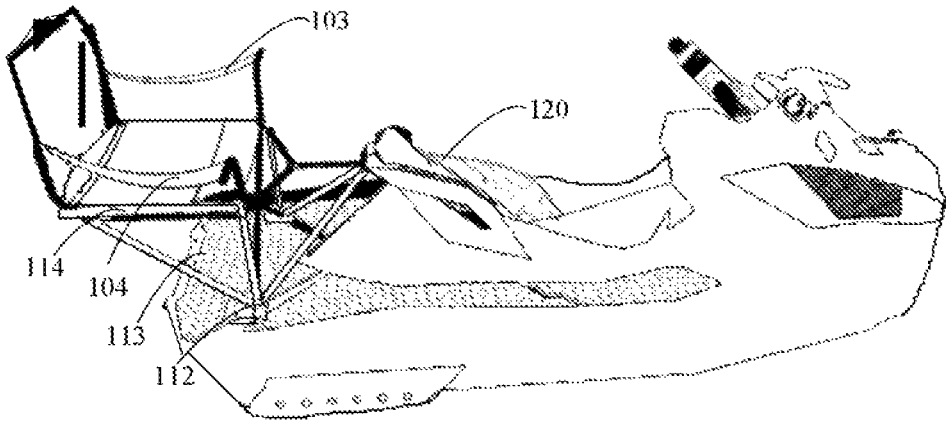
FIG. 1C illustrates a left perspective view of a collapsible chair, according to an embodiment herein.

FIG. 1C illustrates a left perspective view of a collapsible chair, according to an embodiment herein. With respect to FIG. 1C, the collapsible chair includes the right arm support 104 which is extended from the seating assembly. The right arm support 104 is hinged to the right sidebar 114 and the midcross bars 113 respectively. The midcross bars and the pair of legs are attached to the PWC 120 at a foot X brace 112.

Figure 2:
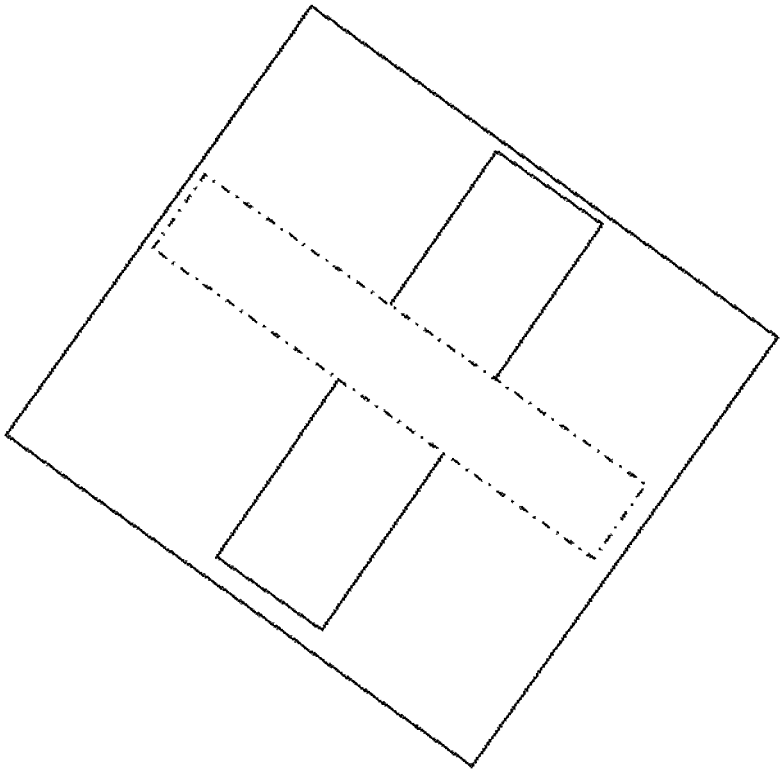
FIG. 2 illustrates a schematic representation of midcross bars in the collapsible chair, according to an embodiment herein.

FIG. 2 illustrates a schematic diagram of a midcross bars in the collapsible chair, according to an embodiment herein. The midcross bars are extended diagonally from the seating assembly. The midcross bars are configured to provide stability to the chair. The chair is designed to collapse and fold up for easy storage.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modifications.

Although the embodiments herein are described with various specific embodiments, it will be obvious for a person skilled in the art to practice the embodiments herein with and without modifications.

What is claimed is:

1. A collapsible chair with two legs comprising:

a seating assembly comprising a seat and a backrest;

a pair of front legs or two front legs extended from the seating assembly;

one or more-mid-cross bars connecting the seating assembly with the pair of front legs;

a left arm support extended from the seating assembly;

a right arm support extended from the seating assembly; and a harness extended forwardly from the two front legs, and wherein the harness comprises a front harness and a secure fastener provided at backend;

wherein the front harness is designed or configured to hold the two front legs in an upright condition through a backend fastener securely fastened to mid-sections of each leg, and wherein the chair is designed to be supported with the two front legs only on ground, and wherein the seat further comprises a fabric sling, and wherein the fabric sling is designed to allow a person to sit and lean back on the backrest, and wherein the two front legs, the right arm support, the left arm support, and the backrest are configured to provide stability and storage functionality through a plurality of collapsible bars, and wherein the front harness extended from the pair of legs is configured to be secured to a personal watercraft (PWC).

2. The chair as claimed in claim 1, wherein the seating assembly is collapsed and folded for storage.

3. The chair as claimed in claim 1, wherein the two front legs are hinged to a footer base.

4. The chair as claimed in claim 1, wherein the one or more mid-cross bars are configured or designed to provide stability.

5. The chair as claimed in claim 1, wherein the left arm support is hinged to a sidebar and the mid-cross bars.

6. The chair as claimed in claim 1, wherein the right arm support is hinged to a sidebar and the mid-cross bars.

7. The chair as claimed in claim 1, wherein a front section of the front harness is secured to the back of a personal watercraft (PWC).

8. The chair as claimed in claim 1, wherein the chair is made of materials selected from a group consisting of steel, hooks, clamps, aluminum, webbing, Velcro, stitching, bungie cord, canvas, mesh material, clasps, plastic, PVC, and neoprene.

9. The chair as claimed in claim 1, wherein the one or more mid-cross bars are designed in the shape of 'X'.

10. The chair as claimed in claim 1, wherein the one or more mid-cross bars are diagonally arranged across a front end or front side of the chair for providing stability.

* * * * *